US011738915B2

(12) United States Patent
Clavel et al.

(10) Patent No.: US 11,738,915 B2
(45) **Date of Patent: *Aug. 29, 2023**

(54) LOCKING TOP FOR VESSEL HAVING A NECK

(71) Applicant: A. RAYMOND ET CIE, Grenoble (FR)

(72) Inventors: Maxime Clavel, Vif (FR); Gaëtan Rey, Voiron (FR)

(73) Assignee: A. RAYMOND ET CIE, Grenoble (FR)

( * ) Notice: Subject to any disclaimer, the term of this patent is extended or adjusted under 35 U.S.C. 154(b) by 163 days.

This patent is subject to a terminal disclaimer.

(21) Appl. No.: 16/911,084

(22) Filed: Jun. 24, 2020

(65) Prior Publication Data

US 2021/0009320 A1 Jan. 14, 2021

(30) Foreign Application Priority Data

Jul. 9, 2019 (FR) ..... 1907693

(51) Int. Cl.
*B65D 51/24* (2006.01)
*B65D 51/18* (2006.01)
(Continued)

(52) U.S. Cl.
CPC ..... *B65D 45/30* (2013.01); *B65D 1/023* (2013.01); *B65D 39/0076* (2013.01);
(Continued)

(58) Field of Classification Search
CPC ..... A61J 1/1406; A61J 1/1412; A61J 1/1425; B65D 1/023; B65D 39/0076; B65D 45/30;
(Continued)

(56) References Cited

U.S. PATENT DOCUMENTS 654,533 A * 7/1900 Garner ..... B65D 41/28 215/277
809,213 A * 1/1906 Osgood ..... B65D 41/62 215/251
(Continued)

FOREIGN PATENT DOCUMENTS

CN 104386350 A 3/2015
EP 2464580 B1 6/2012
(Continued)

OTHER PUBLICATIONS

European Search Report and Search Opinion Received for EP Application No. 20179713, dated on Oct. 30, 2020, 7 pages.
(Continued)

*Primary Examiner* — Gideon R Weinerth
(74) *Attorney, Agent, or Firm* — TraskBritt

(57) ABSTRACT

A locking top for blocking a stopper in the neck of a vessel comprises an outer body and a cage that is configured to fit into and lock axially in the outer body. The cage comprises an upper ring, a plurality n of branches connected to the upper ring, n/2 median bridges and n/2 lower bridges arranged in alternation on the periphery of the cage, each connecting together two adjacent branches. When the top is in an intermediate holding position in which the stopper is partially pushed into the neck, the lower bridges surround, at least in part, a collar of the neck; the median bridges located, in an axial direction, between the upper ring and the lower bridges are designed to form an open space between them and the collar.

12 Claims, 9 Drawing Sheets

(51) Int. Cl.

| | |
|---|---|
| ***A61J 1/14*** | (2023.01) |
| ***B65D 41/48*** | (2006.01) |
| ***B65D 45/30*** | (2006.01) |
| ***B65D 1/02*** | (2006.01) |
| ***B65D 39/00*** | (2006.01) |
| ***B65D 81/18*** | (2006.01) |

(52) U.S. Cl.
CPC ..... *B65D 81/18* (2013.01); *A61J 1/1406* (2013.01); *A61J 1/1412* (2013.01); *B65D 51/241* (2013.01)

(58) Field of Classification Search
CPC .... B65D 51/241; B65D 81/18; B65D 51/002; B65D 51/18
USPC ..... 215/40, 249, 247, 274, 296, 364; 220/320, 315, 787
See application file for complete search history.

(56) References Cited

U.S. PATENT DOCUMENTS 2,950,834 A * 8/1960 Mazza ..... B65D 55/063 215/254
3,025,991 A * 3/1962 Gillon ..... B65D 51/241 215/311
3,948,261 A * 4/1976 Steiner ..... A61B 10/0035 215/307
4,060,911 A * 12/1977 Weiler ..... B67B 3/22 422/1
4,251,003 A * 2/1981 Bodenmann ..... B65D 55/02 215/254
4,306,357 A * 12/1981 Villarejos ..... B65D 51/241 34/284
4,482,071 A * 11/1984 Ishiwatari ..... B65D 55/08 215/251
5,085,332 A * 2/1992 Gettig ..... B65D 55/0872 215/277
5,125,921 A * 6/1992 Duschek ..... B65D 51/002 604/416
5,269,429 A 12/1993 Schumacher
5,314,084 A * 5/1994 Folta ..... B65D 51/241 215/350
5,447,247 A * 9/1995 Derksen ..... B65D 51/002 215/249
5,819,964 A * 10/1998 Grimard ..... B65D 51/002 215/249
5,901,866 A * 5/1999 Storar ..... B65D 51/241 215/249
5,992,660 A * 11/1999 Miura ..... B65D 51/002 215/307
6,426,046 B1 * 7/2002 Cassells ..... B65D 51/1661 215/244
8,225,949 B2 * 7/2012 Aneas ..... B65D 51/002 604/905
D681,230 S * 4/2013 Mosier ..... D24/129
8,684,204 B2 * 4/2014 Belle ..... B65D 51/002 215/274
8,684,225 B2 * 4/2014 Gelibert ..... B65D 51/002 215/277
8,777,031 B2 * 7/2014 Aneas ..... B65D 51/241 215/277
8,950,609 B2 * 2/2015 Aneas ..... B65D 51/002 215/277
8,978,909 B2 * 3/2015 Kakutani ..... B65D 51/002 215/296
9,802,736 B2 * 10/2017 Fournier ..... B65D 41/16
10,144,560 B2 * 12/2018 Mutterle ..... B65D 51/2807
10,843,913 B2 * 11/2020 Mutterle ..... A61J 1/1406
11,535,429 B2 * 12/2022 Clavel ..... B65D 85/70
2003/0029828 A1 * 2/2003 Amschlinger ..... A61J 1/18 215/247
2004/0217081 A1 * 11/2004 Konrad ..... B65D 51/002 215/247
2009/0001042 A1 * 1/2009 Sever ..... B65D 51/241 215/277
2010/0089862 A1 * 4/2010 Schmitt ..... B65D 51/002 215/249
2010/0224632 A1 * 9/2010 Aneas ..... B65D 51/002 220/315
2011/0068106 A1 * 3/2011 Zukor ..... F26B 5/06 220/367.1
2011/0266249 A1 * 11/2011 Kakutani ..... B65D 51/002 215/296
2012/0160850 A1 * 6/2012 Gelibert ..... B65D 55/063 220/315
2012/0187072 A1 * 7/2012 Belle ..... B65D 45/32 215/274
2012/0248057 A1 * 10/2012 Bogle ..... B65D 51/241 53/489
2013/0233822 A1 * 9/2013 Aneas ..... B65D 41/14 215/320
2014/0209603 A1 * 7/2014 Aneas ..... B65D 51/002 220/259.5
2014/0217099 A1 * 8/2014 Browne ..... B65D 51/002 220/259.5
2015/0014316 A1 * 1/2015 Chanas ..... B65D 51/002 215/274
2015/0360826 A1 * 12/2015 Fournier ..... B65D 51/002 215/277
2016/0038373 A1 * 2/2016 Ohlin ..... A61J 1/1406 215/247
2016/0228331 A1 * 8/2016 Tremblay ..... A61J 1/2096
2018/0134457 A1 5/2018 Mutterle
2021/0009319 A1 * 1/2021 Clavel ..... B65D 51/241
2021/0009320 A1 * 1/2021 Clavel ..... B65D 1/023
2023/0036805 A1 * 2/2023 Rey ..... B67C 7/00
2023/0095042 A1 * 3/2023 Richardson ..... B65D 51/002 215/247

FOREIGN PATENT DOCUMENTS

EP 2814752 B1 12/2014
EP 2464577 B1 2/2018
WO 2012/069538 A1 5/2012

OTHER PUBLICATIONS

Chinese Office Action for Application No. 202010645594.7 dated Apr. 6, 2023, 16 pages with machine translation.

* cited by examiner

LOCKING TOP FOR VESSEL HAVING A NECK

PRIORITY CLAIM

This application claims the benefit of the filing date of French Patent Application Serial No. FR1907693, filed Jul. 9, 2019, for "Locking Top for Vessel Having a Neck," the disclosure of which is hereby incorporated herein in its entirety by this reference.

TECHNICAL FIELD

The present disclosure relates to a top for a vessel having a neck, which top is intended to block a stopper in the neck of the vessel. The disclosure relates in particular to a locking top suitable for flasks, for example for pharmaceutical products liable to undergo a freeze-drying step prior to the stopper being locked by the top.

BACKGROUND

Locking tops for vessels having a neck are known from documents EP2464577 and EP2464580. These tops comprise an outer ring and a "muselet" formed of two rings connected together by a plurality of substantially identical branches extending in an axial direction. Such a top makes it possible to block a stopper in the neck of the vessel, the stopper being held in the muselet. For certain medical applications that require the contents of the vessel to be freeze-dried, it is possible to arrange the top on the vessel without pushing the stopper completely in and without locking the top on the neck of the vessel. The stopper furthermore comprises an opening in its foot that allows the water vapor to emerge during the freeze-drying. The applicant has nevertheless observed that the configuration of these tops had an adverse effect on the evaporative flux, thus reducing the freeze-drying effectiveness. This is because, during the freeze-drying, the lower ring of the muselet completely surrounds the neck of the vessel and the ring surrounds the muselet, drastically reducing the gas exchange capacity between the inside and the outside of the vessel.

Document WO2012/069538 proposes a stopping device configured to surround an upper part of the stopper: during freeze-drying, the stopper, which has an opening in its foot, is pushed only partially into the neck of the vessel, and the stopping device does not reach the neck. The evaporative flux can pass through from the opening in the stopper to the outside undisturbed. This solution nevertheless has the drawback that the stopper is held not very securely in the neck during freeze-drying, because only a small part of the foot is held in the neck, whereas a very substantial part of the stopper bearing the stopping device is not held. Furthermore, the stopping device is merely placed on the stopper, and not held thereon: the stopping device and the stopper are therefore liable to become disconnected accidentally.

BRIEF SUMMARY

The present disclosure proposes a solution aimed at overcoming all or some of the drawbacks of the prior art. The present disclosure concerns a locking top that permits effective freeze-drying while providing good holding of the stopper in an intermediate holding position prior to it passing into the locking position.

The present disclosure relates to a locking top for a vessel having a neck, which top is intended to block a stopper in the neck of the vessel and is able to adopt two positions on the vessel: an intermediate holding position in which the stopper is partially pushed into the neck; and a locking position in which the stopper is pushed into and locked in the neck. The top comprises an outer body and a cage that is configured to fit into and lock axially in the outer body. The cage comprises:

- an upper ring,
- a plurality n of branches connected to the upper ring and defining therewith a cylindrical general form of the cage,
- n/2 median bridges and n/2 lower bridges, each connecting together two adjacent branches, the median bridges and the lower bridges being arranged in alternation on the periphery of the cage, each median bridge supporting a first flexible tab intended to block the stopper within the cage, against the upper ring, when the top is in the intermediate holding position, and each lower bridge supporting a second flexible tab.

The top is notable in that, in the intermediate holding position:

- only the lower bridges and the branches are intended to surround a collar of the neck of the vessel,
- the median bridges are located, in an axial direction, between the upper ring and the lower bridges, each median bridge being designed to form an open space between it and the collar.

According to other advantageous non-limitative characteristics of embodiments of the present disclosure, taken alone or in any technically feasible combination:

- the median bridges occupy between 20% and 40% of the perimeter of the cage and the lower bridges occupy between 40% and 70% of the perimeter;
- each open space has a height in the axial direction of between 0.2 mm and 2 mm, and a width, around the perimeter of the cage, substantially equal to the width of a median bridge;
- the second tabs are intended to remain in contact on the collar of the neck of the vessel when the top is in the intermediate holding position, and to come to bear beneath the collar when the top is in its locking position;
- each second tab is inclined towards the inside of the cage, in the direction of the upper ring;
- at least one lower bridge supports a third flexible tab, inclined towards the outside of the cage and oriented towards the upper ring, and has a shear zone adjacent to the third tab, the application of a tensile force to the third tab being capable of causing a break at the shear zone when the top is in the locking position on the vessel, and making it possible to disconnect the cage from the neck;
- the outer body has a shear part in order to allow the body to be withdrawn from the top when the top is in the locking position on the vessel.

The present disclosure furthermore relates to a vessel having a neck with a circular opening, ending in a flared collar, and comprising a stopper arranged in the neck and associated with a locking top such as above.

Advantageously, each second tab is inclined towards the interior of the cage, in the direction of the upper ring, and the n/2 second tabs are configured to allow passage from the intermediate holding position to the locking position of the top on the vessel when a force of between 30 N and 70 N, preferably between 30 N and 50 N, is applied to the top.

BRIEF DESCRIPTION OF THE DRAWINGS

Other characteristics and advantages of the present disclosure will become apparent from the detailed description of certain embodiments that follows with reference to the accompanying drawings, in which.

DETAILED DESCRIPTION

In the descriptive part, the same references in the figures can be used for elements of the same type. The figures are schematic representations that are not necessarily to scale, with a view to readability.

Figure 1A:
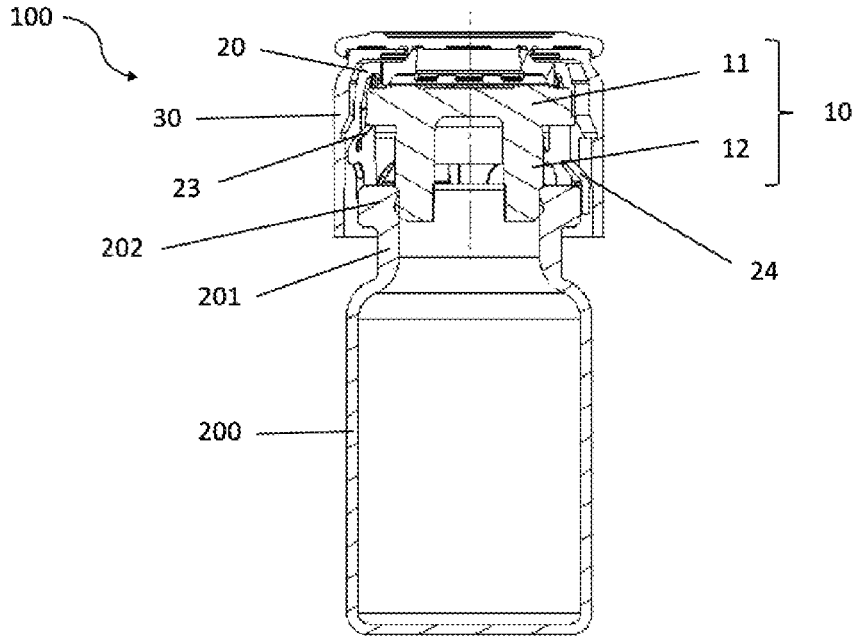
FIGS. 1A and 1B are cross-sectional views, in two orthogonal sections, through a vessel having a neck with a stopper partially pushed into the neck and a locking top in accordance with the present disclosure, in the intermediate holding position.

The present disclosure relates to a locking top 100 for a vessel 200 having a neck, which top 100 is intended to block a stopper 10 in the neck 201 of the vessel 200. The vessel 200 may in particular adopt the form of a flask, having a neck 201 with a circular opening ending in a collar 202 that is flared relative to the outer perimeter of the neck 201. In other words, the external diameter of the collar 202 is greater than the external diameter of the neck 201, as illustrated in FIGS. 1A and 1B.

In the field of pharmaceutical applications, there are standards in terms of internal diameter of the neck 201 of the vessel 200: 13 mm and 20 mm are examples.

The stopper 10 has a circular section and a T-shape with a head 11 and a foot 12, the head 11 being of a greater diameter than the foot 12. Thus, when the foot 12 of the stopper 10 is completely pushed into the neck 201, the head 11 is blocked against the collar 202.

Figure 1B:
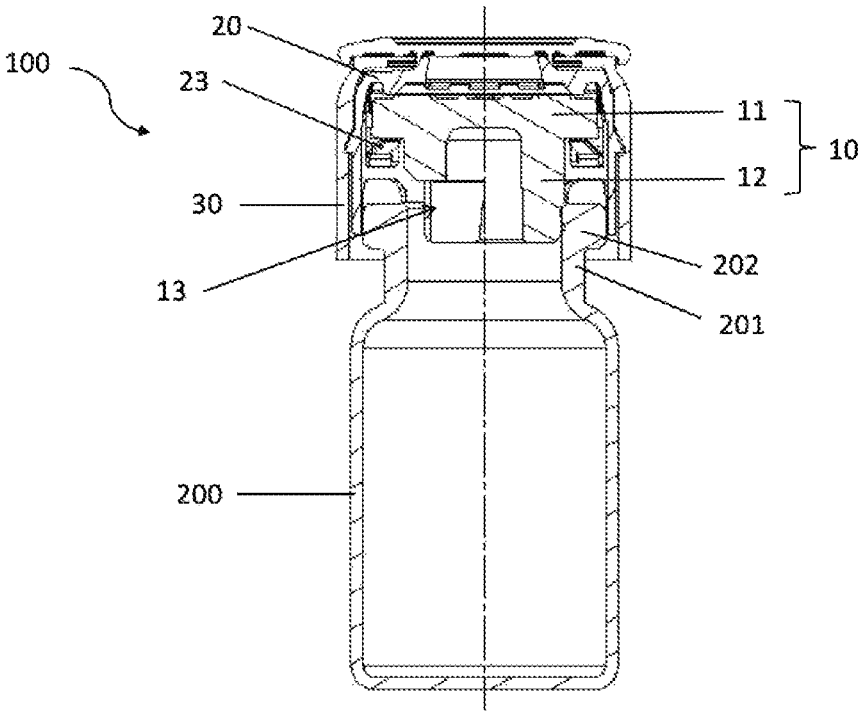
Figure 4A:
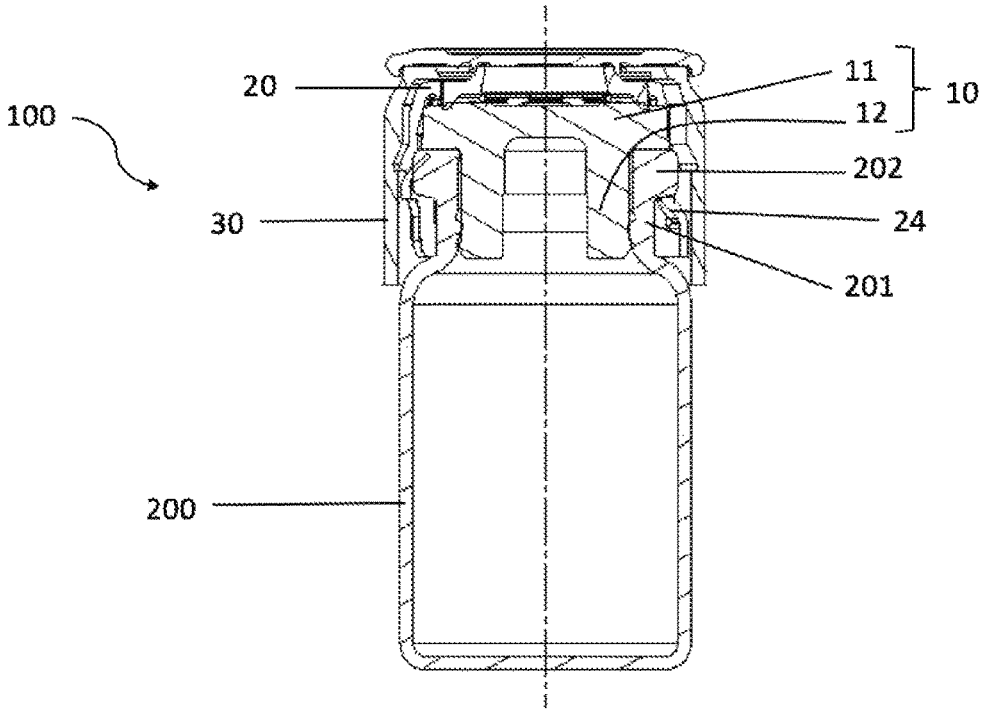
FIGS. 4A and 4B are cross-sectional views, in two orthogonal sections, through a vessel having a neck with a stopper pushed into the neck and a locking top in accordance with the present disclosure, in the locking position.
Figure 4B:
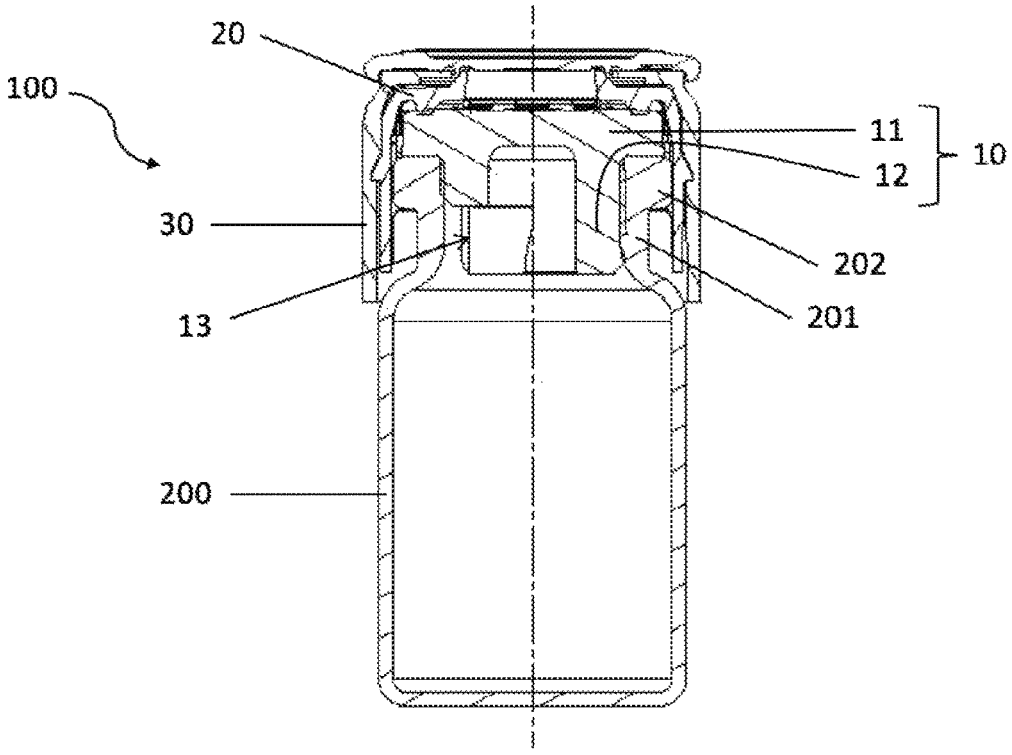

As stated in the introduction, when the contents of the flask are intended to be freeze-dried, the stopper 10 has an opening 13 in its foot 12 to allow the evaporative flux to pass through as long as the stopper 10 is not completely pushed into the neck 202 (FIGS. 1B and 4B).

The top 100, when associated with the stopper 10, is able to adopt two positions on the vessel 200: a first position, referred to as an intermediate holding position, in which the stopper 10 is partially pushed into the neck 201 (FIGS. 1A, 1B, 1C, 1D). The vessel 200 may be subjected to a freeze-drying step in this intermediate holding position, because the partial pushing-in of the stopper allows the evaporative flux to pass through the opening 13 formed in the foot 12 of the stopper 10. The characteristics of the top 100 that allow the effective circulation of this evaporative flux are described subsequently herein.

The top 100 associated with the stopper 10 may also adopt a second position, referred to as a locking position, in which the stopper 10 is totally pushed into and locked in the neck 201 by the top 100 (FIGS. 4A, 4B, 4C, 4D). In this position, the stopper 10 hermetically seals the vessel 200, the foot 12 (and therefore the opening 13) being totally surrounded by the neck 201 of the vessel 200.

The top 100 comprises an outer body 30 and a cage 20 that is configured to fit into and lock axially in the outer body 30.

Figure 2A:
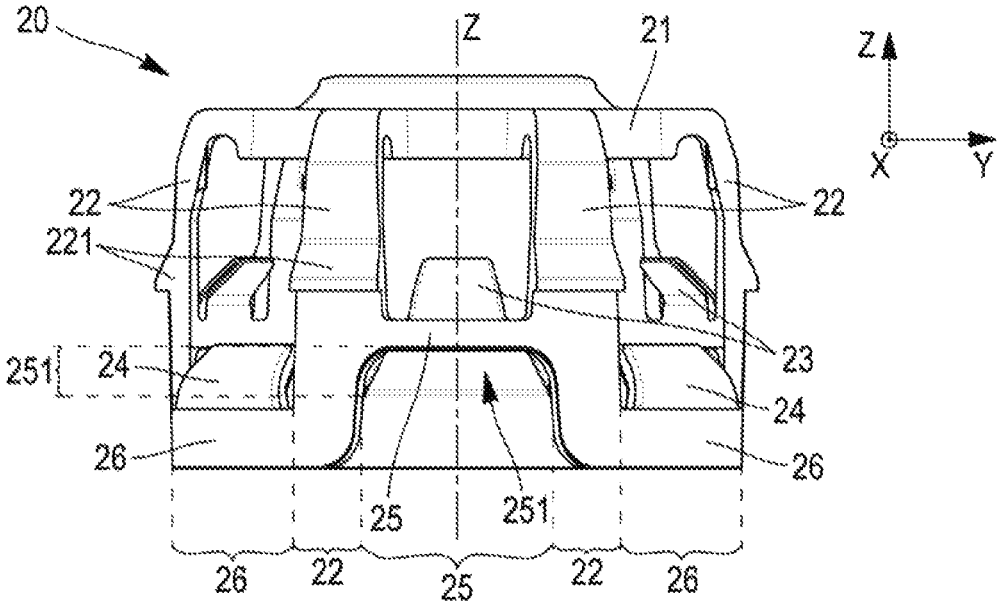
FIG. 2A is a side view of a cage of a locking top according to the present disclosure.
Figure 2B:
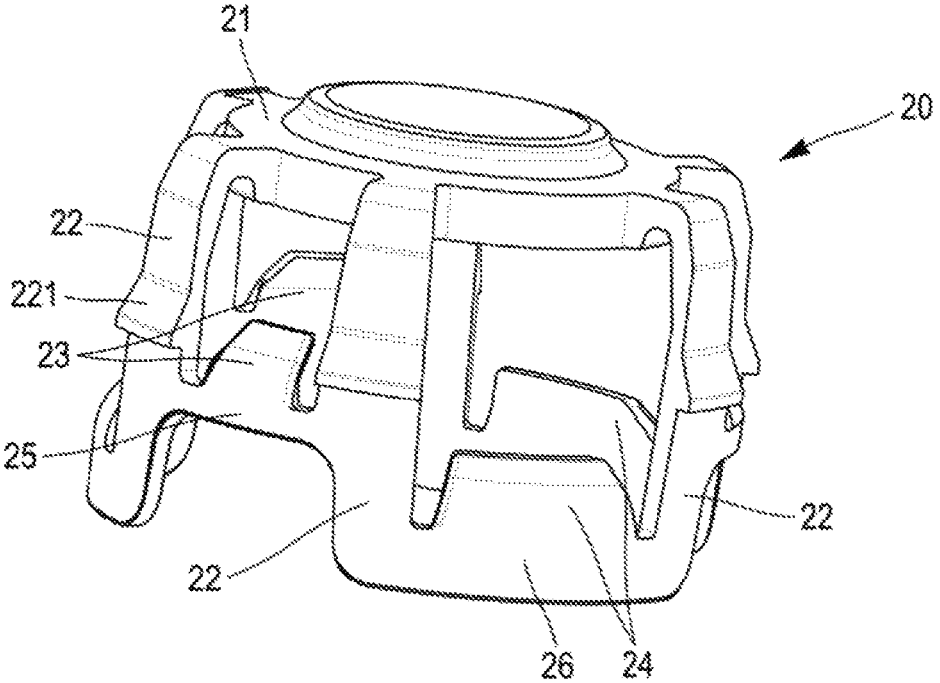
FIG. 2B is a perspective view of the cage shown in FIG. 2A.

The cage 20 comprises an upper ring 21, and a plurality n of branches 22 connected to the upper ring 21 and defining therewith a cylindrical general form of the cage 20, of central axis z (FIGS. 2A, 2B).

The cage 20 also comprises n/2 median bridges 25 and n/2 lower bridges 26, each connecting together two adjacent branches 22. Note that the adjectives "upper," "median" and "lower" are used with reference to a cage 20 mounted in a top 100 in the intermediate holding position or in the locking position on a vessel 200. The vessel 200 being in the vertical position, the upper ring 21 of the cage 20 is in the "top" situation, at a greater height than the other elements of the cage 20; the median bridges 25 and the lower bridges 26 are at a median height and a low height respectively. Thus, the median bridges 25 are located, in an axial direction z, between the upper ring 21 and the lower bridges 26.

The median bridges 25 and the lower bridges 26 are arranged in alternation on the periphery of the cage 20. In the example illustrated in FIGS. 2A and 2B, the cage comprises six branches 22, three median bridges 25 and three lower bridges 26.

Advantageously, the median bridges 25 occupy between 20% and 40% of the perimeter of the cage 20, for example 30%; and the lower bridges 26 occupy between 40% and 70% of the perimeter, for example 60%. The remaining perimeter to make up to 100% is occupied by the branches 22 (FIG. 2A).

The cage 20 furthermore comprises a plurality of first tabs 23, each being supported by a median bridge 25. Each first tab 23 is flexible and inclined relative to the branches 22 towards the inside of the cage 20, by an angle of between 20° and 60°, advantageously around 45°, in the direction of the upper ring 21.

These first tabs 23 are intended to block the stopper 10 within the cage 20, against the upper ring 21, when the stopper 10 is associated with the top 100. The first tabs 23 flex to allow the head 11 of the stopper 10 to pass when the stopper is introduced into the cage 20, and are blocked beneath the head 11 to prevent the stopper 10 from being pulled out of the cage 20.

Owing to these first tabs 23, the stopper 10 remains properly integral with the top 100 and no accidental separation of the stopper 10 and top 100 can occur, in particular when the top 100 is in its intermediate holding position on the vessel 200.

The cage 20 also comprises a plurality of second tabs 24, each supported by a lower bridge 26. Each second tab 24 is flexible and inclined relative to the branches 22 towards the inside of the cage 20, by an angle of between 20° and 60°, advantageously around 30°, in the direction of the upper ring 21.

These second tabs 24 are intended to remain above the collar 202, slightly raised or in contact therewith, when the top 100 is in the intermediate holding position (FIG. 1A). In this intermediate holding position, the lower bridges 26 and the branches 22 are intended to surround the collar 202 at least in part. This configuration permits more stable and secure mechanical holding of the stopper 10/top 100 unit during the freeze-drying steps.

Figure 1C:
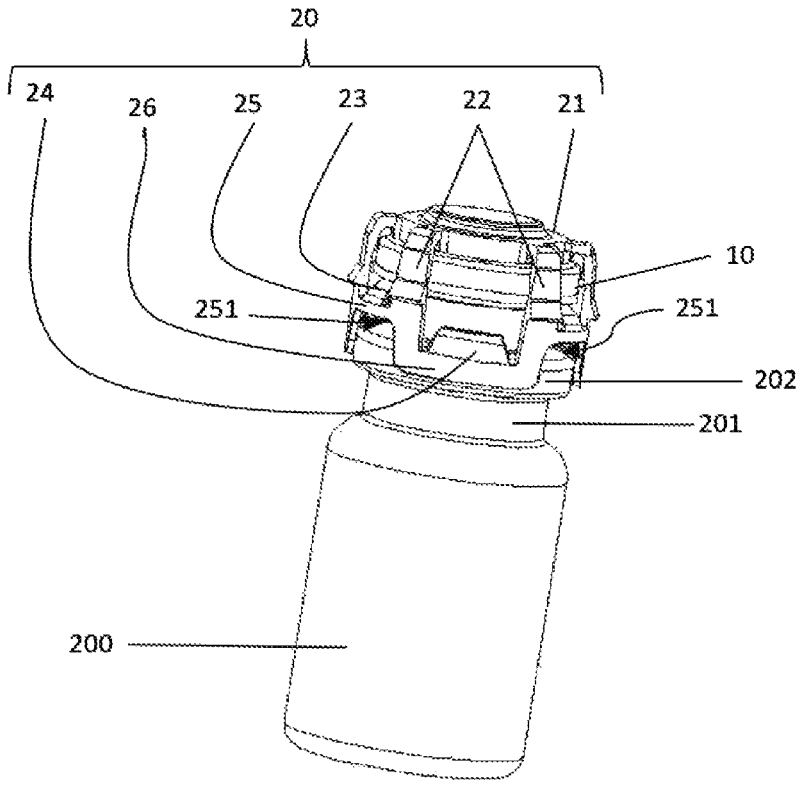
FIG. 1C is a perspective view of a vessel having a neck with a stopper partially pushed into the neck and a cage of a locking top, in accordance with the present disclosure, in the intermediate holding position.
Figure 1D:
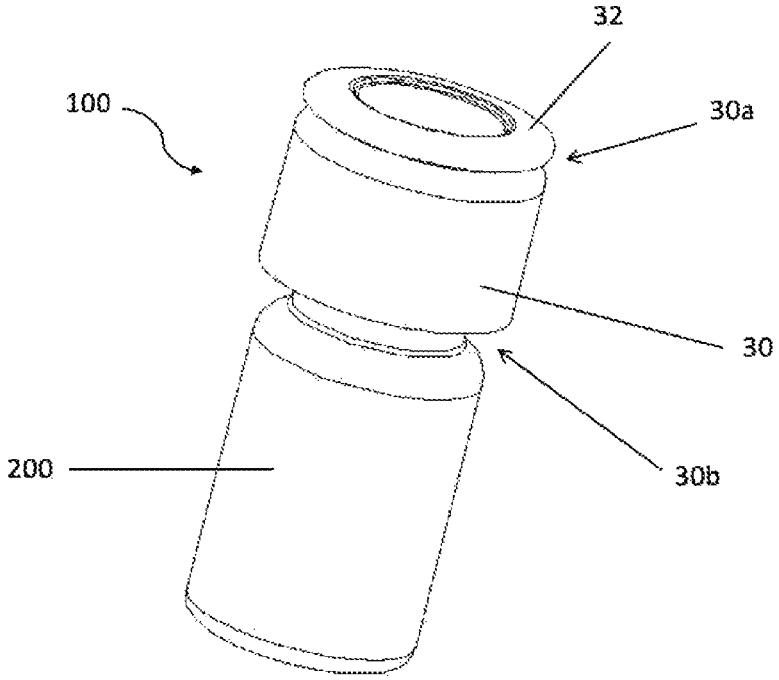
FIG. 1D is a perspective view of a vessel having a neck with a stopper (not shown) and a locking top in accordance with the present disclosure, the top being arranged on the vessel, in the intermediate holding position.

In the cage 20 according to the present disclosure, each median bridge 25 is designed to form an open space 251 between it and the collar 202 when the top 100 is in its intermediate holding position (FIG. 1C). The cage 20 thus has n/2 open spaces 251 distributed over its periphery, permitting effective evacuation of the evaporative flux during freeze-drying steps.

Advantageously, each open space 251 has a height in the axial direction z of between 0.2 mm and 2 mm, and a width around the perimeter of the cage 20 substantially equal to the width of a median bridge 25. The height of the open space 251 may be defined as the distance in the axial direction z between the median bridge 25 and a line marking the start of the inclination towards the inside of the cage 20 of the second tabs 24 (FIG. 2A). This is because it is at this line of the start of inclination that the contact between the collar 202 and the second tabs 24 is able to be established, thus defining the intermediate holding position.

Figure 4C:
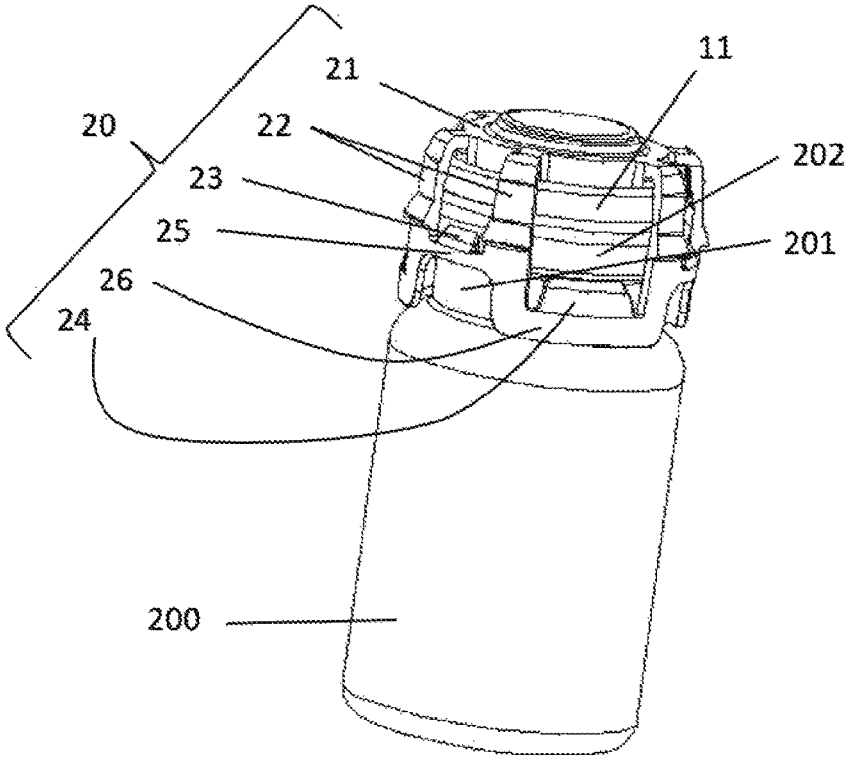
FIG. 4C is a perspective view of a vessel having a neck with a stopper pushed into the neck and a cage of a locking top, in accordance with the present disclosure, in the locking position.
Figure 4D:
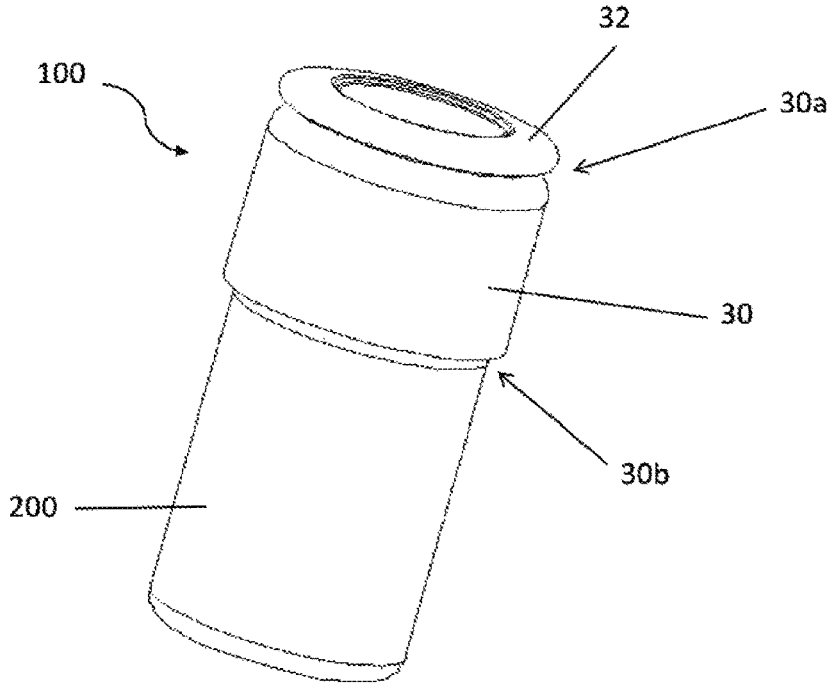
FIG. 4D is a perspective view of a vessel having a neck with a stopper (not shown) and a locking top in accordance with the present disclosure, the top being arranged on the vessel, in the locking position.

Furthermore, the second tabs 24 are intended to come to bear beneath the collar 202 of the neck 201 of the vessel 200 when the top 100 is in the locking position (FIGS. 4A, 4C). This is because, when it passes into the locked position, the stopper 10/top 100 unit will move down into/around the neck 201 of the vessel 200, so as to push the foot 12 of the stopper 10 completely into the neck 201 until its head 11 is bearing on the collar 202. When it is pushed in, the second tabs 24 flex and move aside to allow the collar 202 past, and become blocked beneath the collar, thus locking the stopper 10 on the vessel 200.

Note that, in the locking position, the first tabs 23 move aside because they are bearing against the peripheral rim of the collar 202. They therefore do not remain beneath the head 11 of the stopper 10, and allow the head 11 to bear on the collar 202. The median bridges 25 then surround the peripheral rim of the collar 202, eliminating the open space 251.

Advantageously, the second tabs 24 are configured to permit movement of the top 100 and associated stopper 10 from the intermediate holding position to the locking position when a low force of between 30 N and 70 N, preferably between 30 N and 50 N, is applied to the top 100.

For this, the second tabs 24 have an inclination relative to the branches 22 of the order of 20° to 60°, a thickness of between 0.6 and 1.3 mm, and a flexibility imparted by the choice of the material forming the cage 20.

This advantageous configuration, owing to which it is made possible to pass into the locking position by applying a low-amplitude force, makes it possible to collectively lock a plurality of tops 100 onto their respective vessels 200, by means of a plate that exerts a force in the upper part of the plurality of tops 100. This low closing force also makes it possible to compensate for the major variations in height of the vessels 200 and thus to arrive at closing of all of the vessels 200 present beneath the closing plate without causing breakage.

Returning to the description of the other elements of the top 100 according to the present disclosure, the outer body 30 is of a cylindrical general form of central axis z (FIGS. 1D, 3A, 3B, 4D). One end 30*a* of the outer body 30 is semi-closed and the other end 30*b* is open. The open end 30*b* is provided to receive the cage 20, which will fit into the outer body 30, arranging the upper ring 21 against the inner surface of the semi-closed end 30*a*.

The outer body 30 is configured to surround the cage 20 completely when the cage is fitted in, so as to prevent any access to the cage 20 from the outside when the top 100 is locking the stopper 10 on the vessel 200.

Figure 3A:
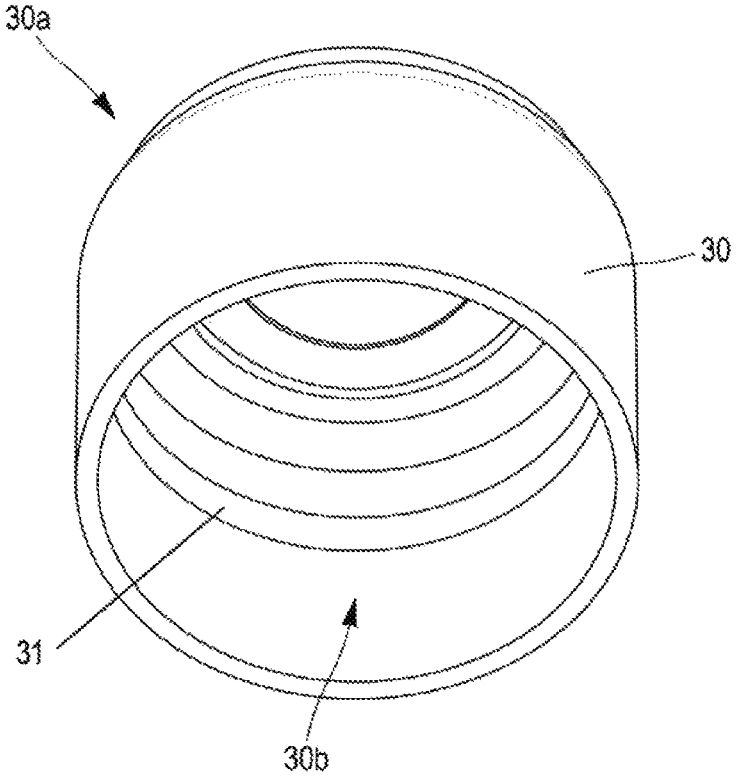
FIG. 3A is a bottom perspective view of an outer body of a locking top according to the present disclosure.
Figure 3B:
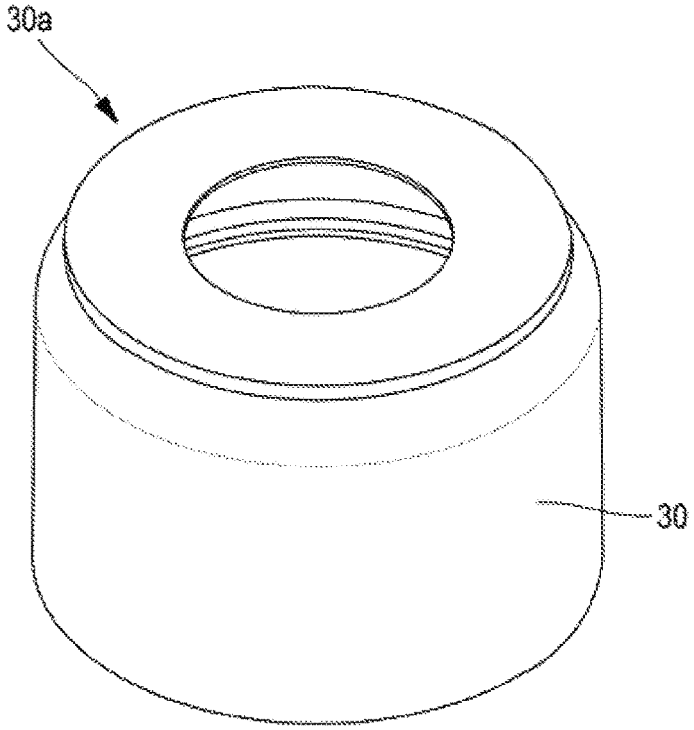
FIG. 3B is a top perspective view of the outer body of the locking top shown in FIG. 3A.

The outer body 30 comprises a circular groove 31, formed in its cylindrical inner walls and capable of cooperating with complementary means of the cage 20 to axially lock the cage 20 in the outer body 30 (FIG. 3A). These means are, for example, catches 221 arranged on the branches 22 of the cage 20 (which can be seen in FIGS. 2A and 2B) and provided to become blocked in the groove 31 when the cage 20 is introduced completely into the outer body 30. The outer body 30 can thus turn freely about the central axis z when the top 100 is in the locking position on the vessel without damaging the cage 20 and risking adversely affecting the reliability and the closing tightness of the vessel 200.

Figure 3C:
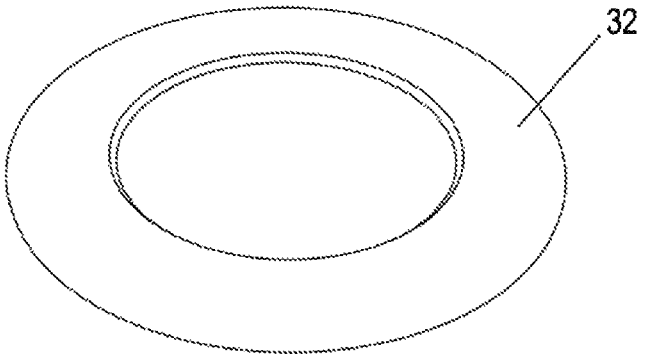
FIG. 3C is a top perspective view of a cap for the outer body of a locking top in accordance with the present disclosure.
Figure 3D:
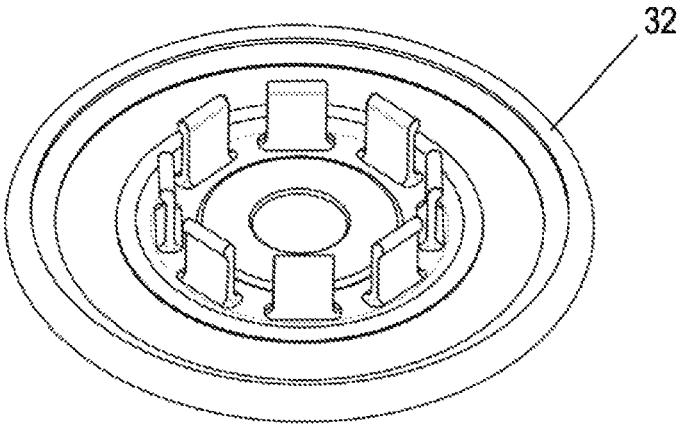
FIG. 3D is a bottom perspective view of the cap shown in FIG. 3C.

The semi-closed end 30*a* of the outer body 30 is closed off by a cap 32, the function of which is to prevent any access to the stopper 10 (FIGS. 3C, 3D). When it is desired to access the contents of the vessel 200, the cap 32 has to be withdrawn, thus causing the orifice of the semi-closed end 30*a* and of the upper ring 21 of the cage 20 to appear: the head 11 of the stopper 10 is accessible and the contents of the vessel 200 can be sampled, for example, by inserting a needle through the stopper 10.

Advantageously, the cap 32 once withdrawn cannot be fixed to the outer body 30 again, so as to ensure single use of the vessel 200 and its contents. The irreversible methods of fixing the cap 32 to the body 30, which are known from documents EP2464577 and EP2464580, can be used in the context of the present disclosure.

It will also be noted that, as the stopper 10 can be introduced into the top 100 once the cage 20, the outer body 30 and the cap 32 forming the top 100 have been assembled, the locking top 100 and the stopper can advantageously be stored separately prior to being used.

According to one particular embodiment of the present disclosure, the locking top 100 is able to be withdrawn completely and allows the stopper 10 to be withdrawn to totally open the vessel (FIGS. 5A to 5E).

Figure 5A:
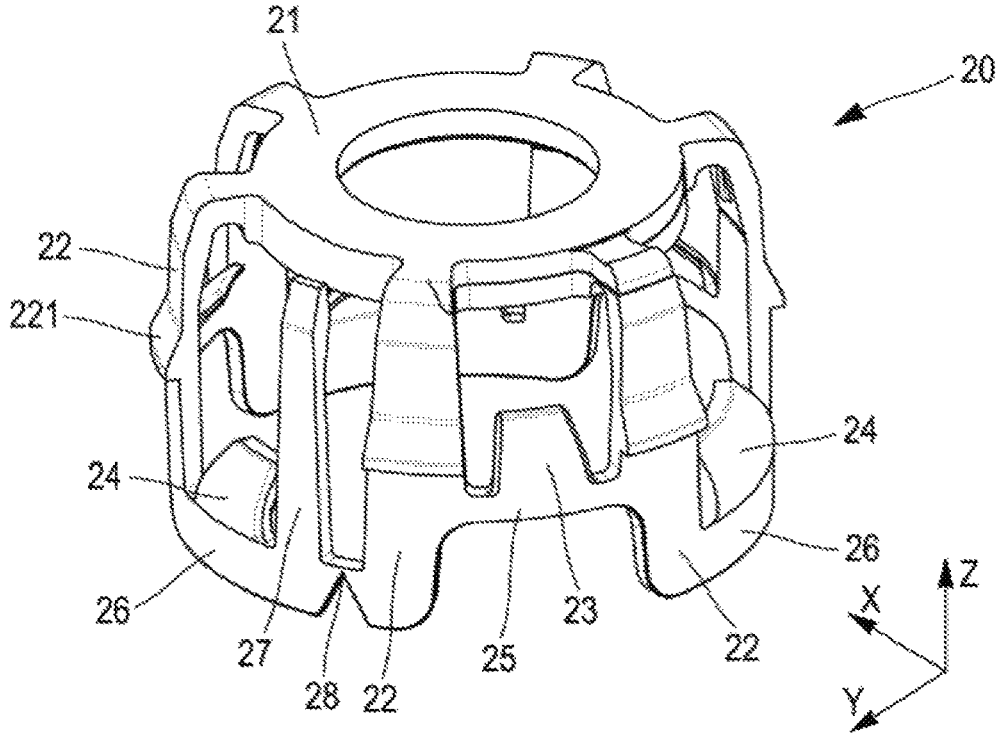
FIG. 5A is a top perspective view of a cage of a locking top for a vessel having a neck, in accordance with a particular embodiment of the present disclosure.

In this case, the cage 20 comprises at least one lower bridge 26 supporting a third tab 27, which is inclined towards the outside of the cage 20, in the direction of the upper ring 21. The (at least one) lower bridge 26 furthermore has a shear zone 28 adjacent to the third tab 27 (FIG. 5A).

Figure 5B:
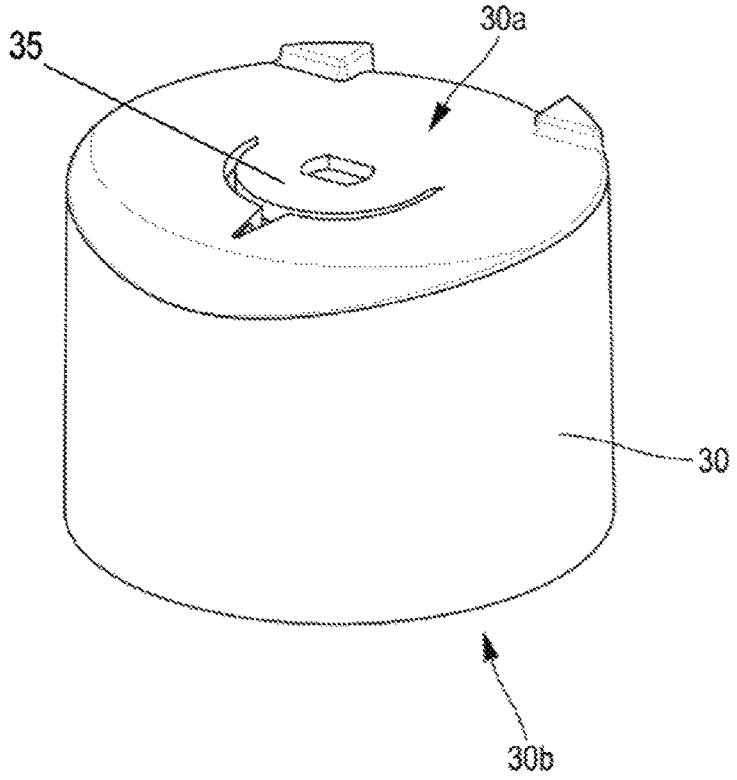
FIG. 5B is a top perspective view of an outer body of a locking top for a vessel having a neck, in accordance with a particular embodiment of the present disclosure.
Figure 5C:
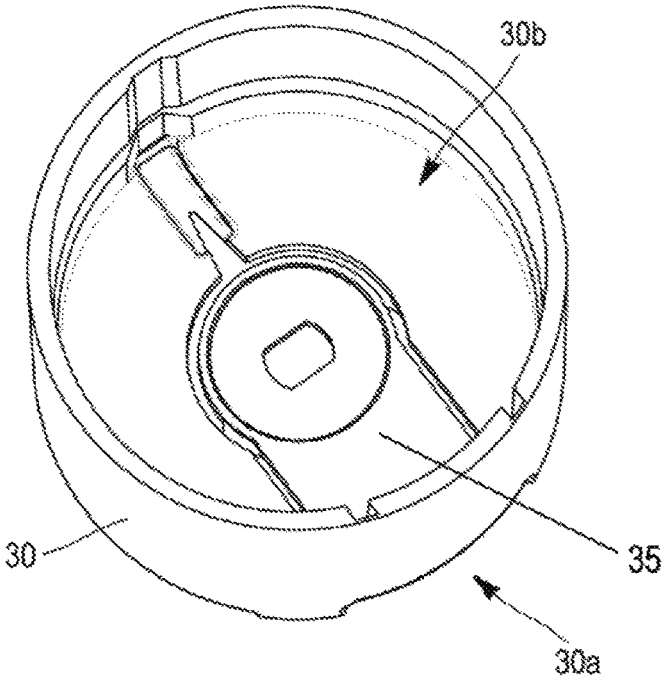
FIG. 5C is a bottom perspective view of the outer body shown in FIG. 5B.
Figure 5D:
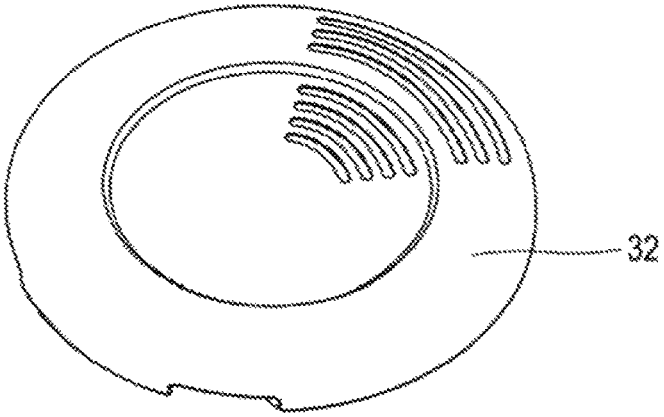
FIG. 5D is a top perspective view of a cap of an outer body of a locking top for a vessel having a neck, in accordance with a particular embodiment of the present disclosure.
Figure 5E:
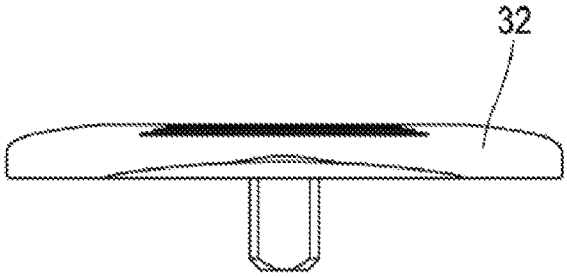
FIG. 5E is a side view of the cap shown in FIG. 5D.

The outer body 30 also has a shear part 35 (FIGS. 5B, 5C). The shear part 35 may for example consist of a portion of the semi-closed end 30*a* and of the cylindrical wall, the portion being defined by a double groove at which the thickness of the outer body 30 is reduced (FIG. 5C). A cap 32, as illustrated for example in FIGS. 5D and 5E, is fixed to the outer surface of the semi-closed end 30*a* of the outer body 30. For this, the cap 32 may comprise a stud intended to pass through an orifice present for example in the center of the semi-closed end 30*a* of the outer body 30, and, in particular, in that portion of the end that belongs to the shear part 35. The cap 32 and the outer body 30 may be fixed together by heat staking.

In practice, when it is desired to access the contents of the vessel 200, an edge of the cap 32 is lifted in order to grasp it and exert a tearing force. This force is transmitted from the cap 32 to the shear part 35 by means of the stud heat-staked in the orifice of the closed end 30*a* of the outer body 30. This force, if sufficient, will induce breaking at the double groove owing to its reduced thickness. A portion of the closed end 30*a* and of the cylindrical wall of the outer body 30 being removed, the outer body 30 can be easily withdrawn.

This gives access to the cage 20 that locks the stopper 10 in the neck 201 of the vessel 200. Remember that the third tab 27 is initially devised such that it is inclined towards the outside of the cage 20, in the direction of the upper ring 21; owing to its elastic properties, it is capable of folding down parallel to the inner walls of the outer body 30 when the cage 20 is locked axially in the outer body 30. When the outer body 30 is withdrawn, the third tab 27 advantageously regains its initial inclination, towards the outside of the cage 20, which facilitates its being gripped by the user. The opening tab 27 is advantageously of elongate form, which facilitates gripping even more.

The gripping and the application of a tensile force to the third tab 27 causes a break at the shear zone 28 of the lower bridge 26: the cage 20 can then be easily disconnected from the neck 201 of the vessel 200, leaving free access for the stopper 10 to be withdrawn.

The third tab 27, by its form, inclination and location relative to the shear zone 28 formed on a second bridge 26, promotes reliable and repeatable breaking over a plurality of cages 20.

The various elements forming the top 100 according to the present disclosure (cage 20, outer body 30, cap 32) are preferably produced by molding a plastics material compatible with the freeze-drying processes, with the gamma, autoclave and ethylene oxide (ETO) sterilization processes, and with the intended fields of application. For example, the cage 20, the outer body 30 and the cap 32 may be formed from materials such as polycarbonate (PC), polypropylene (PP) or polybutylene terephthalate (PBT). Note that the cap 32 can be formed from flexible plastics materials such as, for example, polypropylene (PP), in order to facilitate its gripping, in the particular embodiment of the top 100, which can be withdrawn totally.

Of course, the invention is not limited to the embodiments and examples described, and variants may be made thereto without departing from the scope of the invention as defined by the claims.

What is claimed is:

1. A locking top for blocking a stopper in a neck of a vessel, comprising:

an outer body; and a cage configured to fit into and lock axially in the outer body; the cage including:

an upper ring, a plurality n of branches connected to the upper ring and defining therewith a cylindrical general form of the cage, n/2 median bridges and n/2 lower bridges, each connecting together two adjacent branches, the median bridges and the lower bridges being arranged in alternation on the periphery of the cage, each median bridge supporting a first flexible tab intended to block the stopper within the cage, against the upper ring, when the top is in an intermediate holding position, and each lower bridge supporting a second flexible tab, wherein, the top is able to adopt two positions on the vessel: the intermediate holding position in which the stopper is partially pushed into the neck; and a locking position in which the stopper is pushed into and locked in the neck; and wherein, while the top is in the intermediate holding position:

only the lower bridges and the branches surround a collar of the neck of the vessel, and the median bridges are located, in an axial direction, between the upper ring and the lower bridges, such that each median bridge forms an open space between the median bridge and the collar along the axial direction, wherein a height of the open space is defined in the axial direction between the median bridge and a level flush with the collar, marking a start of inclination of the second tabs toward the inside of the cage, the height being between 0.2 mm and 2.0 mm such that vapor can pass through the open space when the locking top is in the intermediate holding position.

2. The locking top of claim 1, wherein the median bridges occupy between 20% and 40% of the perimeter of the cage and the lower bridges occupy between 40% and 70% of the perimeter.

3. The locking top of claim 2, wherein each open space has:

a width, around the perimeter of the cage, substantially equal to the width of a median bridge.

4. The locking top of claim 3, wherein the second tabs remain in contact on the collar of the neck of the vessel when the top is in the intermediate holding position, and bear beneath the collar when the top is in the locking position.

5. The locking top of claim 4, wherein at least one lower bridge supports a third flexible tab, inclined toward the outside of the cage and oriented toward the upper ring, the at least one lower bridge having a shear zone adjacent to the third tab, the shear zone configured to break responsive to application of a tensile force to the third tab when the top is in the locking position on a vessel so as to enable disconnection of the cage from the neck of the vessel.

6. The locking top of claim 5, wherein the outer body has a shear part configured to enable the outer body to be withdrawn from the cage when the locking top is in the locking position on the vessel.

7. The locking top of claim 1, wherein each open space has a width, around the perimeter of the cage, substantially equal to the width of a median bridge.

8. The locking top of claim 1, wherein the second tabs remain in contact on the collar of the neck of the vessel when the top is in the intermediate holding position, and bear beneath the collar when the top is in the locking position.

9. The locking top of claim 1, wherein at least one lower bridge supports a third flexible tab, inclined toward the outside of the cage and oriented toward the upper ring, the at least one lower bridge having a shear zone adjacent to the third tab, the shear zone configured to break responsive to application of a tensile force to the third tab when the top is in the locking position on a vessel so as to enable disconnection of the cage from the neck of the vessel.

10. The locking top of claim 9, wherein the outer body has a shear part configured to enable the outer body to be withdrawn from the cage when the locking top is in the locking position on the vessel.

11. A vessel having a neck with a circular opening, ending in a flared collar, and comprising a stopper arranged in the neck and associated with the locking top according to claim 1, wherein each second tab is inclined toward the inside of the cage, in the direction of the upper ring, and the n/2 second tabs are configured to allow passage from the intermediate holding position to the locking position of the top on the vessel when a force of between 30 N and 70 N is applied to the top.

12. The vessel of claim 11, wherein the n/2 second tabs are configured to allow passage from the intermediate holding position to the locking position of the top on the vessel when a force of between 30 N and 50 N is applied to the top.

* * * * *